United States Patent [19]

LaCross

[11] 3,970,211

[45] July 20, 1976

[54] NON-REMOVABLE TAB CONNECTION

[75] Inventor: George D. LaCross, Burbank, Ill.

[73] Assignee: Continental Can Company, Inc., New York, N.Y.

[22] Filed: Apr. 21, 1975

[21] Appl. No.: 569,711

[52] U.S. Cl. ..... 220/267; 220/268; 220/277; 220/375; 222/81

[51] Int. Cl.[2] ..... B65D 41/32

[58] Field of Search ..... 220/269, 268, 375, 277, 220/267; 222/81, 80

[56] References Cited

UNITED STATES PATENTS

| | | | |
|---|---|---|---|
| 3,338,461 | 8/1967 | Cookson | 220/269 |
| 3,807,597 | 4/1974 | Wells et al. | 220/277 |
| 3,887,105 | 6/1975 | Chiappe | 220/268 |

*Primary Examiner*—George T. Hall
*Attorney, Agent, or Firm*—John J. Kowalik; Joseph E. Kerwin; William A. Dittmann

[57] ABSTRACT

An end closure having a non-detachable flap partially severable from the end panel to provide an opening. The flap is recessed below the remainder of the panel and is broken away by a tab which fits into the recess. The tab is adapted to be pushed inwardly and, after rupturing the score between the end panel and the flap, functions to swing the flap inwardly about a hinge formed by an unscored area of the flap perimeter. The invention is primarily directed to a means of attaching the tab to the flap so as to provide a lost motion enabling the movement of the flap relative to the tab during the inward swing.

8 Claims, 5 Drawing Figures

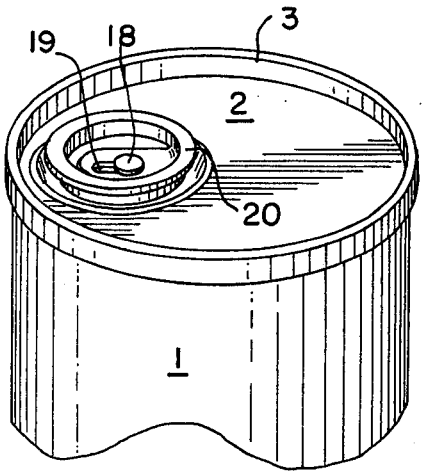
FIG. 1
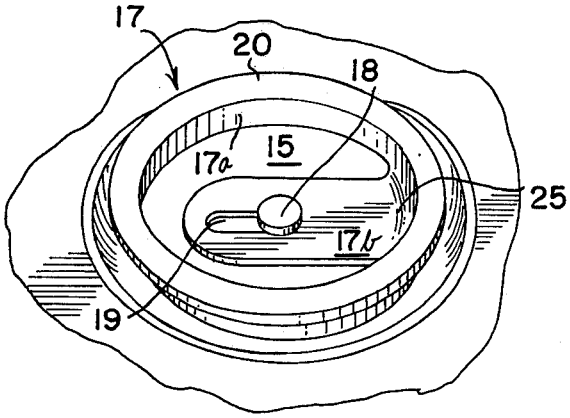
FIG. 2
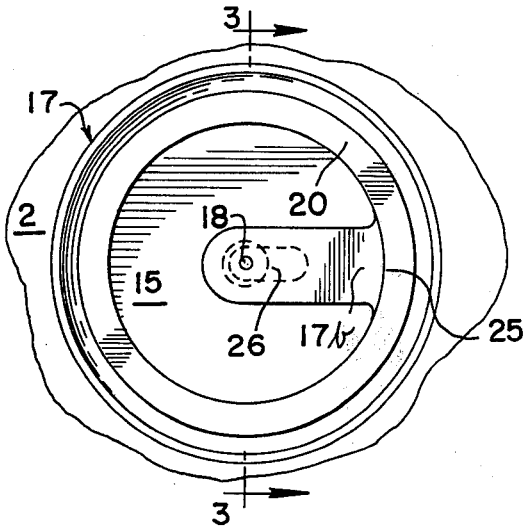
FIG. 3
FIG. 4
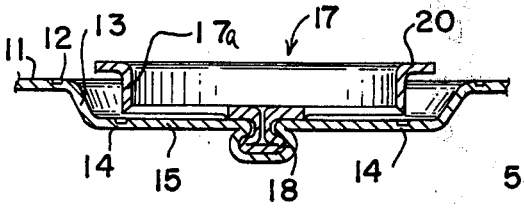
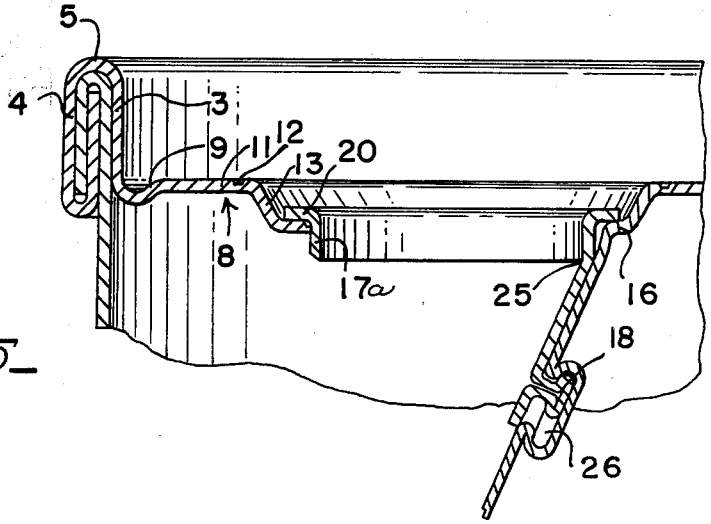
FIG. 5

NON-REMOVABLE TAB CONNECTION

SUMMARY OF THE INVENTION

Many attempts have been recently made to provide an ecologically acceptable easy-open container wherein the parts are not separable from the container. Recent interest is dominated by the push-in types in which the end panel of the container is partially scored and the resulting flap is adapted to be pressed into the container while hinging about the unscored area. One of the principal problems has been the difficulty in providing for the relative movement of the tab and the flap caused by the separation of the points about which they hinge during opening. Failure to do so may necessitate an excessive amount of opening force and may further result in distortion of the tab and/or malfunction of the closure during opening.

It is, therefore, an object of the present invention to improve the opening characteristics of a non-detachable push-in type end closure. This is accomplished by attaching the tab to the flap so as to provide for a lost motion therebetween.

With the above and other objects in view that will hereinafter appear, the nature of the invention will more clearly be understood by reference to the following specifications when viewed in light of the accompanying drawing, in which:

FIG. 1 is a top fragmentary perspective view of the top of a can having in association therewith one embodiment of the present invention.

FIG. 2 is an enlarged fragmentary view of the structure shown in FIG. 1.

FIG. 3 is a top plan view of another embodiment of the present invention.

FIG. 4 is a cross-sectional view taken substantially along line 4—4 of FIG. 3.

FIG. 5 is a fragmentary cross-sectional view, showing the closure of FIG. 4 in the opened condition.

DESCRIPTION OF THE FIRST PREFERRED EMBODIMENT - FIGS. 1–3

The embodiment shown herein in association with a metal can generally designated 1, comprises an end panel 2 having a chuck wall 3 merging with a seaming panel 4 through a seaming panel radius 5. The end panel 2 is formed in an area between the center and the chuck wall 3 with an annular rim 8 which has a peripheral frust-conical side wall 9 adjoining at its upper edge a preferably flat web 11 which is formed on its upper side with an anti-rupture U-score 12. The web 11 adjoins a downwardly coned inner wall 13 which at its base is formed with a crush score 14, said score 14 partially encircling a flap 15. The uncrushed area provides a hinge portion 16 which connects the flap 15 with the end panel 2 wherein the flap 15 is torn away from the end panel 2 and pushed into the container as hereinafter described.

The flap 15 is opened by a tab 17 comprising a tubular element **17*a* and a flat radial tether 17*b* interior to said tubular element 17*a* and overlying said hinge 16. The tether 17*b* is formed with a slot 19 at its distal end, said slot 19 being oriented along a line connecting the rivet 18 and the hinge 16. A rivet 18, formed in the center of the flap 15, passes through the slot 19, movably attaching the tab 17 to the flap 15. The other end of the tether 17*b* is integral with a peripheral edge of an annular horizontally disposed flange 20 of the tubular element 17*a* of the tab 17**.

The tubular element **17*a* is spaced with its lower edge slightly above the score 14 and is dimensioned to fit tightly thereinto. When the tab 17 is pressed panelwardly, the score 14 is ruptured and the flap 15 is pushed into the container, hinging at the unscored portion 16. The tether 17*b* hinges at its point of juncture 25 with the flange 20. This separation of the hinge points causes a relative motion between the rivet 18 and the tether 17*b* during opening which results in relative movement between the rivet 18 and tab along the slot 19 toward the end thereof nearer the hinge 16. This motion allows easy opening of the closure while avoiding tab distortion or closure malfunction and while maintaining the tab 17** attached to the container.

In a similar manner, the slot 19 may be replaced with a channel formed in the tab 2 and co-operating with the rivet 18.

DESCRIPTION OF THE SECOND PREFERRED EMBODIMENT - FIGS. 4 AND 5

In this embodiment, the rivet 18 is integrally formed on the panelward side of the tether **17*b* and co-operates with a channel 26 formed in the center of the flap 15 along a line connected in the center of the flap 15 to the hinge 16. The channel 26 allows movement of the tab 17 relative to the flap 15 while retaining the tab 17** attached to the container.

I claim:

1. An improved non-detachable easy-opening end closure for a can or similar container comprising an end panel, a score formed in said end panel and defining therein a flap element adapted to be torn away from said end panel to provide an opening, a tab element superposed with respect to said flap, flap retention means for retaining said flap attached to said end closure subsequent to opening and tab attachment means attaching said tab to said flap, said attachment means providing a lost motion between said flap element and said tab element during opening of said end closure.

2. An improved non-detachable easy-opening end closure for a can or similar container comprising an end panel, a score formed in said end panel and defining therein a flap element adapted to be torn away from said end panel to provide an opening, a tab element superposed with respect to said flap, flap retention means for retaining said flap attached to said end closure subsequent to opening, and tab attachment means attaching said tab to said flap, said attachment means providing a lost motion between said flap element and said tab element during opening of said end closure, said tab element including a substantially flat tether and said tab attachment means comprising a rivet integrally formed in said flap and a slot formed in said tether, said rivet co-operating with said slot to permit said lost motion between said tab element and said flap element.

3. The invention according to claim 2, wherein said slot extends lengthwise of said tether.

4. The invention according to claim 3, wherein said rivet is disposed substantially centrally on said flap element.

5. An improved non-detachable easy-opening end closure for a can or similar container comprising an end panel, a score formed in said end panel and defining therein a flap element adapted to be torn away from said end panel to provide an opening, a tab element superposed with respect to said flap, flap retention means for retaining said flap attached to said end closure subsequent to opening, and tab attachment means attaching said tab to said flap, said attachment means providing a lost motion between said flap element and said tab element during opening of said end closure, said attachment means comprising a rivet integrally formed in one of said elements and a channel formed in the other of said elements, said rivet co-operating with said channel to permit a lost motion between said elements attendant to opening said flap element.

6. The invention according to claim 5, wherein said rivet is formed in said tether and said channel is formed in said flap element.

7. The invention according to claim 2, wherein said flap is non-removably attached to said end panel by an unscored area in the flap perimeter.

8. The invention according to claim 7, wherein said unscored area lies beneath said tether.

* * * * *